US010226664B2

(12) United States Patent
Dalebout et al.

(10) Patent No.: US 10,226,664 B2
(45) Date of Patent: Mar. 12, 2019

(54) EXERCISE MACHINE WITH MULTIPLE EXERCISING MODES

(71) Applicant: ICON Health & Fitness, Inc., Logan, UT (US)

(72) Inventors: William T. Dalebout, North Logan, UT (US); Gaylen Ercanbrack, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 15/163,996

(22) Filed: May 25, 2016

(65) Prior Publication Data

US 2016/0346599 A1 Dec. 1, 2016

Related U.S. Application Data

(60) Provisional application No. 62/166,547, filed on May 26, 2015.

(51) Int. Cl.
*A63B 21/00* (2006.01)
*A63B 22/00* (2006.01)
(Continued)

(52) U.S. Cl.
CPC ..... *A63B 22/06* (2013.01); *A63B 21/00192* (2013.01); *A63B 21/22* (2013.01);
(Continued)

(58) Field of Classification Search
CPC ..... A63B 21/00058; A63B 21/00069; A63B 21/00072; A63B 21/00076;
(Continued)

(56) References Cited

U.S. PATENT DOCUMENTS 4,828,522 A * 5/1989 Santos ..... A63B 22/0605 441/129
5,354,251 A 10/1994 Sleamaker
(Continued)

FOREIGN PATENT DOCUMENTS

CA 2509122 12/2006
CH 708378 1/2015
(Continued)

OTHER PUBLICATIONS

European Patent Application No. 16168504.5 office action dated Oct. 7, 2016 with search report.
(Continued)

*Primary Examiner* — Gary D Urbiel Goldner
(74) *Attorney, Agent, or Firm* — Ray Quinney & Nebeker

(57) ABSTRACT

An exercise machine includes a frame, a seat selectively movable with respect to the frame, and a resistance mechanism connected to the frame. The seat is adjustably positioned between an upright position that orients a user in an upright orientation with respect to a pedal assembly when the exercise machine is in an upright exercise mode and a recumbent position that orients the user in a recumbent orientation with respect to the pedal assembly when the exercise machine is in a recumbent cycling exercise mode.

20 Claims, 6 Drawing Sheets

(51) Int. Cl.

| | |
|---|---|
| ***A63B 22/06*** | (2006.01) |
| ***A63B 24/00*** | (2006.01) |
| *A61H 1/02* | (2006.01) |
| *A63B 21/015* | (2006.01) |
| *A63B 21/22* | (2006.01) |

(52) U.S. Cl.
CPC ..... *A63B 21/4034* (2015.10); *A63B 21/4035* (2015.10); *A63B 22/001* (2013.01); *A63B 22/0015* (2013.01); *A63B 22/0605* (2013.01); *A63B 22/0664* (2013.01); *A63B 24/0087* (2013.01); *A61H 1/0214* (2013.01); *A63B 21/015* (2013.01); *A63B 21/225* (2013.01); *A63B 2022/067* (2013.01); *A63B 2022/0676* (2013.01); *A63B 2208/0204* (2013.01); *A63B 2208/0233* (2013.01); *A63B 2208/0238* (2013.01); *A63B 2225/09* (2013.01)

(58) Field of Classification Search
CPC ..... A63B 21/00192; A63B 21/005; A63B 21/0051; A63B 21/0052; A63B 21/0056; A63B 21/0057; A63B 21/012; A63B 21/0125; A63B 21/015; A63B 21/15; A63B 21/159; A63B 21/22; A63B 21/225; A63B 21/4027; A63B 21/4033; A63B 21/4034; A63B 21/4035; A63B 21/4045; A63B 21/4047; A63B 21/4049; A63B 22/001; A63B 22/0015; A63B 22/0017; A63B 22/0046; A63B 22/06; A63B 22/0605; A63B 22/0664; A63B 2022/067; A63B 2022/0676; A63B 23/035; A63B 23/03516; A63B 23/03533; A63B 23/0355; A63B 23/03558; A63B 23/03566; A63B 23/03575; A63B 23/03591; A63B 23/04; A63B 23/0405; A63B 23/0423; A63B 23/0476; A63B 23/0482; A63B 23/0494; A63B 23/12; A63B 23/1245; A63B 23/1272; A63B 23/1281; A63B 24/0087; A63B 2024/0093; A63B 2208/0204; A63B 2208/0228; A63B 2208/0233; A63B 2208/0238; A63B 2225/09; A63B 2225/093; A63B 2225/10; A63B 2225/102

See application file for complete search history.

(56) References Cited

U.S. PATENT DOCUMENTS

| | | | | |
|---|---|---|---|---|
| 5,445,583 | A | 8/1995 | Habing | |
| 5,823,915 | A | 10/1998 | Chen | |
| 5,850,460 | A | 12/1998 | Tanaka et al. | |
| 5,916,065 | A | 6/1999 | McBride et al. | |
| 5,944,638 | A * | 8/1999 | Maresh | A63B 22/0605 482/110 |
| 6,497,426 | B2 | 12/2002 | VanPelt | |
| 6,648,353 | B1 | 11/2003 | Cabal | |
| 6,682,462 | B1 | 1/2004 | Lee | |
| 6,926,645 | B1 | 8/2005 | Stearns et al. | |
| 8,002,671 | B1 * | 8/2011 | Vigilia | A63B 22/0605 482/142 |
| 8,062,190 | B2 | 11/2011 | Pyles et al. | |
| 8,764,609 | B1 * | 7/2014 | Elahmadie | A63B 22/0023 482/1 |
| 8,827,872 | B2 | 9/2014 | Tamari et al. | |
| 8,951,168 | B2 | 2/2015 | Baudhuin | |
| 9,474,925 | B1 * | 10/2016 | Hsiung | A63B 21/225 |
| 9,616,281 | B2 * | 4/2017 | Hsiung | A63B 22/0664 |
| 2002/0004439 | A1 * | 1/2002 | Galbraith | A63B 22/0605 482/57 |
| 2005/0075222 | A1 | 4/2005 | Adley | |
| 2005/0129258 | A1 | 6/2005 | Fincham | |
| 2006/0226630 | A1 | 10/2006 | Tolhurst | |
| 2007/0287597 | A1 | 12/2007 | Cameron | |
| 2009/0239714 | A1 * | 9/2009 | Sellers | A63B 22/001 482/52 |
| 2010/0206652 | A1 | 8/2010 | Kielland | |
| 2011/0028277 | A1 * | 2/2011 | Merli | A63B 23/03575 482/63 |
| 2011/0177919 | A1 * | 7/2011 | Tamari | A63B 22/0605 482/57 |
| 2012/0322625 | A1 | 12/2012 | Park | |
| 2013/0260964 | A1 | 10/2013 | Chia et al. | |
| 2013/0260965 | A1 * | 10/2013 | Chia | A63B 22/06 482/57 |
| 2013/0260966 | A1 | 10/2013 | Chia et al. | |
| 2013/0260967 | A1 | 10/2013 | Chia et al. | |
| 2014/0274574 | A1 * | 9/2014 | Shorten | A63B 22/0046 482/52 |

FOREIGN PATENT DOCUMENTS

| | | |
|---|---|---|
| CN | 202261701 | 5/2012 |
| CN | 102753240 | 10/2012 |
| JP | 2007134955 | 5/2007 |
| TW | 200946173 | 11/2009 |
| TW | M493398 | 1/2015 |
| WO | 2009156996 | 12/2009 |

OTHER PUBLICATIONS

English Translation of the Abstract of CH708378. Jan. 30, 2015.
English Translation of Taiwan First Office Action and Search Report issued for 105115278 dated Mar. 21, 2017.
English Translation of Chinese Office Action and Search Report issued for 2014800275002 dated Jan. 31, 2018.

* cited by examiner

EXERCISE MACHINE WITH MULTIPLE EXERCISING MODES

RELATED APPLICATIONS

This application claims priority to U.S. Patent Application Ser. No. 62/166,547 titled "Exercise Machine with Multiple Exercising Modes" and filed on 26 May 2015, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Generally, the human body can adequately supply enough oxygen to meet the body's demands at the intensity levels involved with aerobic exercise. Popular forms of aerobic exercise include running, jogging, swimming, and cycling among others activities. In contrast, anaerobic exercise often involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One such type of aerobic exercise machine is an elliptical exercise machine, which often includes foot supports that move in fixed reciprocating directions when moved by the feet of a user. Often, the foot supports are mechanically linked to arm levers that can be held by the user during the workout. The arm levers and foot supports move together and collectively provide resistance against the user's motion during the user's workout. Other popular exercise machines that allow a user to perform aerobic exercises indoors include treadmills, rowing machines, and stepper machines, to name a few.

Another popular form of aerobic exercise is cycling. Cycling is typically done on stationary bikes indoors or on moving bikes outside that travel off road or on streets. With a traditional upright bicycle, the user rests his or her body weight entirely on a small portion of the bike's seat, handles, and pedals. With an upright bike, the user typically leans forward as he or she pedals. Another form of cycling is recumbent cycling. With a recumbent bicycle, the user is often reclined in a seat with a back support which distributes the user's weight over a larger area, including the user's back.

One type of cycling is disclosed in U.S. Pat. No. 6,497,426 issued to James L. Vanpelt, et al. In this reference, a bicycle provides a frame having forward and rear frame portions that selectively attach and detach from each other in upright and recumbent positions. In the upright position, cranks are connected to a gear box that is adapted to drive a typical chain sprocket. In the recumbent position, the cranks are removed from the rear gear box and are attached to a forward gear box. A drive shaft is positioned between the gear boxes so that the bicycle rider may power the bicycle from the forward gear box. The bicycle may also be configured to be used as a tandem with a second set of cranks attached to the rear gear box. Other types of cycling devices are disclosed in U.S. Pat. No. 6,648,353 to Pedro Pablo Cabal and U.S. Patent Publication No. 2013/0260964 issued to Benjamin Chia.

SUMMARY

In the preferred embodiment of the present invention an exercise machine includes a frame, a seat selectively movable with respect to the frame, and a resistance mechanism connected to the frame. The seat is adjustably positioned between an upright position that orients a user in an upright orientation with respect to the pedal assembly when the exercise machine is in an upright exercise mode and a recumbent position that orients the user in a recumbent orientation with respect to the pedal assembly when the exercise machine is in a recumbent cycling exercise mode.

In one aspect of the invention, which can be combined with any other aspect of the invention, the exercise machine comprises a pedal assembly.

In one aspect of the invention, which can be combined with any other aspect of the invention, the pedal assembly further comprises a first beam and a first platform positioned in a mid-region of the first beam.

In one aspect of the invention, which can be combined with any other aspect of the invention, the first beam is also in communication with the resistance mechanism.

In one aspect of the invention, which can be combined with any other aspect of the invention, a first rod connected to the first beam and selectively movable with respect to the first beam.

In one aspect of the invention, which can be combined with any other aspect of the invention, a first pedal is connected to the rod.

In one aspect of the invention, which can be combined with any other aspect of the invention, the pedal assembly further comprises a second rod.

In one aspect of the invention, which can be combined with any other aspect of the invention, a second platform is connected to the second beam.

In one aspect of the invention, which can be combined with any other aspect of the invention, a second rod is connected to the second beam and selectively movable with respect to the second beam.

In one aspect of the invention, which can be combined with any other aspect of the invention, a second pedal is connected to the rod.

In one aspect of the invention, which can be combined with any other aspect of the invention, a first arm support is movably coupled to the first beam.

In one aspect of the invention, which can be combined with any other aspect of the invention, a second arm support is moveably coupled to the second beam.

In one aspect of the invention, which can be combined with any other aspect of the invention, the first arm support and the second arm support move in a reciprocating motion during the performance of the exercise.

In one aspect of the invention, which can be combined with any other aspect of the invention, the frame is rotatably connected to a base structure.

In one aspect of the invention, which can be combined with any other aspect of the invention, the first rod is selectively movable between multiple orientations with respect to the first beam where each of the selected multiple orientations is maintained during the performance of the exercise.

In one aspect of the invention, which can be combined with any other aspect of the invention, an upright orientation of the multiple orientations forms a forward angle between the first rod and first beam.

In one aspect of the invention, which can be combined with any other aspect of the invention, a recumbent orientation of the multiple orientations forms a rearward angle between the first rod and first beam.

In one aspect of the invention, which can be combined with any other aspect of the invention, an elliptical orientation of the multiple orientations forms an angle of 15.0 degrees or less between the first rod and first beam.

In one aspect of the invention, which can be combined with any other aspect of the invention, a console member is connected to the frame.

In one aspect of the invention, which can be combined with any other aspect of the invention, the console member is pivotally connected to the frame.

In one aspect of the invention, which can be combined with any other aspect of the invention, a console is pivotally attached to a free end of the console member.

In one aspect of the invention, which can be combined with any other aspect of the invention, the pedal assembly further comprises a first crank arm connected to the rotary resistance mechanism and connected to at least the first beam.

In one aspect of the invention, which can be combined with any other aspect of the invention, an exercise machine comprises a frame.

In one aspect of the invention, which can be combined with any other aspect of the invention, a seat is selectively movable with respect to the frame.

In one aspect of the invention, which can be combined with any other aspect of the invention, a resistance mechanism is connected to the frame.

In one aspect of the invention, which can be combined with any other aspect of the invention, a pedal assembly is movably attached to the frame and movable in a performance of an exercise.

In one aspect of the invention, which can be combined with any other aspect of the invention, the pedal assembly comprises a first beam.

In one aspect of the invention, which can be combined with any other aspect of the invention, a first platform is positioned in a mid-region of the first beam.

In one aspect of the invention, which can be combined with any other aspect of the invention, the first beam is in communication with the resistance mechanism.

In one aspect of the invention, which can be combined with any other aspect of the invention, a first rod is connected to the first beam and selectively movable with respect to the first beam.

In one aspect of the invention, which can be combined with any other aspect of the invention, a first pedal is connected to the rod.

In one aspect of the invention, which can be combined with any other aspect of the invention, a second beam is in communication with the resistance mechanism.

In one aspect of the invention, which can be combined with any other aspect of the invention, a second platform is connected to the second beam.

In one aspect of the invention, which can be combined with any other aspect of the invention, a second rod is connected to the second beam and selectively movable with respect to the second beam.

In one aspect of the invention, which can be combined with any other aspect of the invention, a second pedal is connected to the rod.

In one aspect of the invention, which can be combined with any other aspect of the invention, a first arm support is movably coupled to the first beam.

In one aspect of the invention, which can be combined with any other aspect of the invention, a second arm support is moveably coupled to the second beam.

In one aspect of the invention, which can be combined with any other aspect of the invention, the first arm support and the second arm support move in a reciprocating motion during the performance of the exercise.

In one aspect of the invention, which can be combined with any other aspect of the invention, the seat is adjustably positioned between an upright position that orients a user in an upright orientation with respect to the pedal assembly when the exercise machine is in an upright exercise mode and a recumbent position that orients the user in a recumbent orientation with respect to the pedal assembly when the exercise machine is in a recumbent cycling exercise mode.

In one aspect of the invention, which can be combined with any other aspect of the invention, the first rod is selectively movable between multiple orientations with respect to the first beam where each of the selected multiple orientations is maintained during the performance of the exercise.

In one aspect of the invention, which can be combined with any other aspect of the invention, an upright orientation of the multiple orientations forms a forward angle between the first rod and first beam.

In one aspect of the invention, which can be combined with any other aspect of the invention, a recumbent orientation of the multiple orientations forms a rearward angle between the first rod and first beam.

In one aspect of the invention, which can be combined with any other aspect of the invention, an elliptical orientation of the multiple orientations forms an angle of 15.0 degrees or less between the first rod and first beam.

In one aspect of the invention, which can be combined with any other aspect of the invention, a console member is pivotally connected to the frame.

In one aspect of the invention, which can be combined with any other aspect of the invention, a console is pivotally attached to a free end of the console member.

In one aspect of the invention, which can be combined with any other aspect of the invention, the pedal assembly further comprises a first crank arm connected to the rotary resistance mechanism and connected to at least the first beam.

In one aspect of the invention, which can be combined with any other aspect of the invention, an exercise machine includes a frame.

In one aspect of the invention, which can be combined with any other aspect of the invention, a seat is selectively movable with respect to the frame.

In one aspect of the invention, which can be combined with any other aspect of the invention, a resistance mechanism is connected to the frame.

In one aspect of the invention, which can be combined with any other aspect of the invention, a pedal assembly is movably attached to the frame and movable in a performance of an exercise.

In one aspect of the invention, which can be combined with any other aspect of the invention, the pedal assembly comprises a first beam.

In one aspect of the invention, which can be combined with any other aspect of the invention, a first platform is positioned in a mid-region of the first beam.

In one aspect of the invention, which can be combined with any other aspect of the invention, the first beam is in communication with the resistance mechanism.

In one aspect of the invention, which can be combined with any other aspect of the invention, a first rod is connected to the first beam and selectively movable with respect to the first beam.

In one aspect of the invention, which can be combined with any other aspect of the invention, a first pedal is connected to the rod.

In one aspect of the invention, which can be combined with any other aspect of the invention, a second beam is in communication with the resistance mechanism.

In one aspect of the invention, which can be combined with any other aspect of the invention, a second platform is connected to the second beam.

In one aspect of the invention, which can be combined with any other aspect of the invention, a second rod is connected to the second beam and selectively movable with respect to the second beam.

In one aspect of the invention, which can be combined with any other aspect of the invention, a second pedal is connected to the rod.

In one aspect of the invention, which can be combined with any other aspect of the invention, a first arm support is movably coupled to the first beam.

In one aspect of the invention, which can be combined with any other aspect of the invention, a second arm support is moveably coupled to the second beam.

In one aspect of the invention, which can be combined with any other aspect of the invention, a console member is pivotally connected to the frame.

In one aspect of the invention, which can be combined with any other aspect of the invention, a console is pivotally attached to a free end of the console member.

In one aspect of the invention, which can be combined with any other aspect of the invention, the first rod is selectively movable between an upright orientation that forms a forward angle between the first rod and first beam, a recumbent orientation that forms a rearward angle between the first rod and first beam, an elliptical orientation that forms an angle of 15.0 degrees or less between the first rod and first beam.

In one aspect of the invention, which can be combined with any other aspect of the invention, the seat is adjustably positioned between an upright position that orients a user in an upright orientation with respect to the pedal assembly when the exercise machine is in an upright exercise mode and a recumbent position that orients the user in a recumbent orientation with respect to the pedal assembly when the exercise machine is in a recumbent cycling exercise mode.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees.

Figure 1:
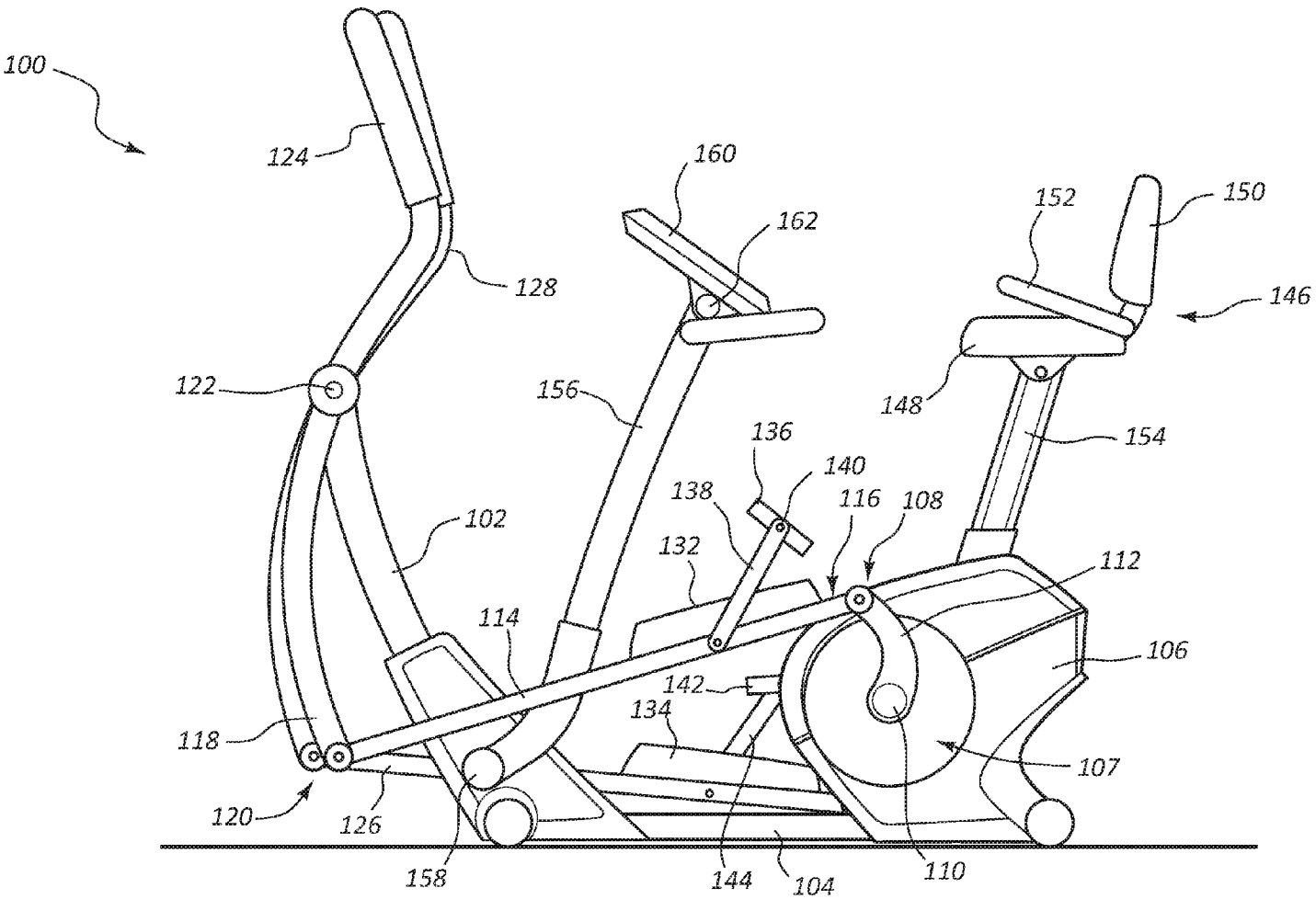
FIG. 1 illustrates a side view of an example of an exercise machine in an upright cycling mode accordance with the present disclosure.

Particularly, with reference to the figures, FIG. 1 depicts an example of an exercise machine 100. The exercise machine 100 includes a frame 102 attached to a base 104. At least a portion of the frame 102 is covered by an outer covering 106, which hides at least some of the internal components of the exercise machine 100. In this example, a resistance mechanism is housed in the outer covering 106 and is attached to a crank assembly 108. The crank assembly 108 includes a crank axle 110 connected to a first crank arm 112 and a second crank arm (not shown).

The first crank arm 112 is attached to a first beam 114 on a first end 116 and to a first arm support 118 on a second end 120. The first arm support 118 is pivotally attached to the frame 102 at a pivot connection 122. The first arm support 118 also includes a handle 124 on a far end of the first arm support 118. The second crank arm is attached to a second beam 126 on a first end and to a second arm support 128 on a second end. The second arm support 128 is pivotally attached to the frame 102 at the pivot connection 122. The second arm support 128 also includes a handle 130 on a far end of the second arm support 128.

A first platform 132 is attached to the first beam 114. In this example, the first platform 132 is directly attached to a surface of the first beam 114, and the first platform 132 is supported by the first beam 114 along the first platform's length. Likewise, a second platform 134 is attached to the second beam 126. In this example, the second platform 134 is directly attached to a surface of the second beam 126, and the first platform 132 is likewise supported by the second beam 126 along the first platform's length.

A first pedal 136 is also attached to the first beam 114. In this example, the first pedal 136 is attached to the first beam 114 through a first rod 138. In the example of FIG. 1, the first rod is positioned in an upright orientation that forms a rearward angle between the first rod 138 and the first beam 114. The rearward angle is maintained during the performance of an exercise. The first pedal 136 is free to rotate about a pedal axle 140. Likewise, a second pedal 142 is also attached to the second beam 126. In this example, the second pedal 142 is attached to the first beam 114 through a second rod 144. In the example of FIG. 1, the second rod 144 is also positioned in an upright orientation that forms a rearward angle between the second rod 144 and the second beam 126. This rearward angle is also maintained during the performance of an exercise.

A seat 146 is connected to the frame 102. In this example, the seat comprises a padded region 148, a back support 150, a handle 152, and support rod 154. Also, a console member 156 is attached to the frame 102 at a member pivot connection 158. A console 160 is attached to the console member 156 at a console pivot connection 162.

Figure 2:
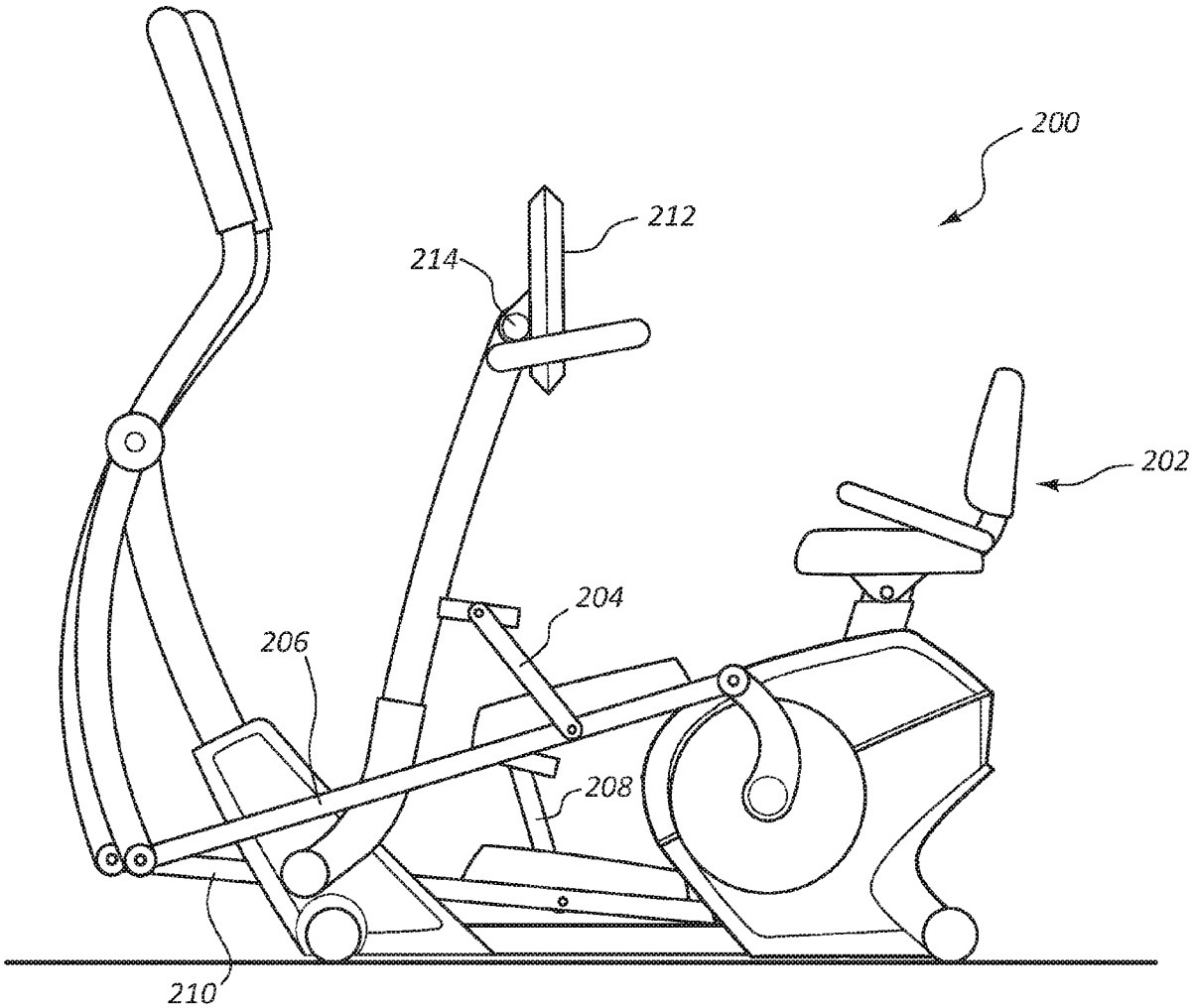
FIG. 2 illustrates a side view of an example of an exercise machine in a recumbent cycling mode accordance with the present disclosure.

FIG. 2 depicts an example of an exercise machine 200 with a seat 202 at a lower elevation than the seat 146 depicted in FIG. 2. Further, the first rod 204 connected to the first beam 206 and the second rod 208 connected to the second beam 210 are in a forward position such that the first and second rods 204, 208 form forward angles with the first and second beams 206, 210, respectively. Also, the console 212 is tilted downward through the console pivot connection 214.

Figure 3:
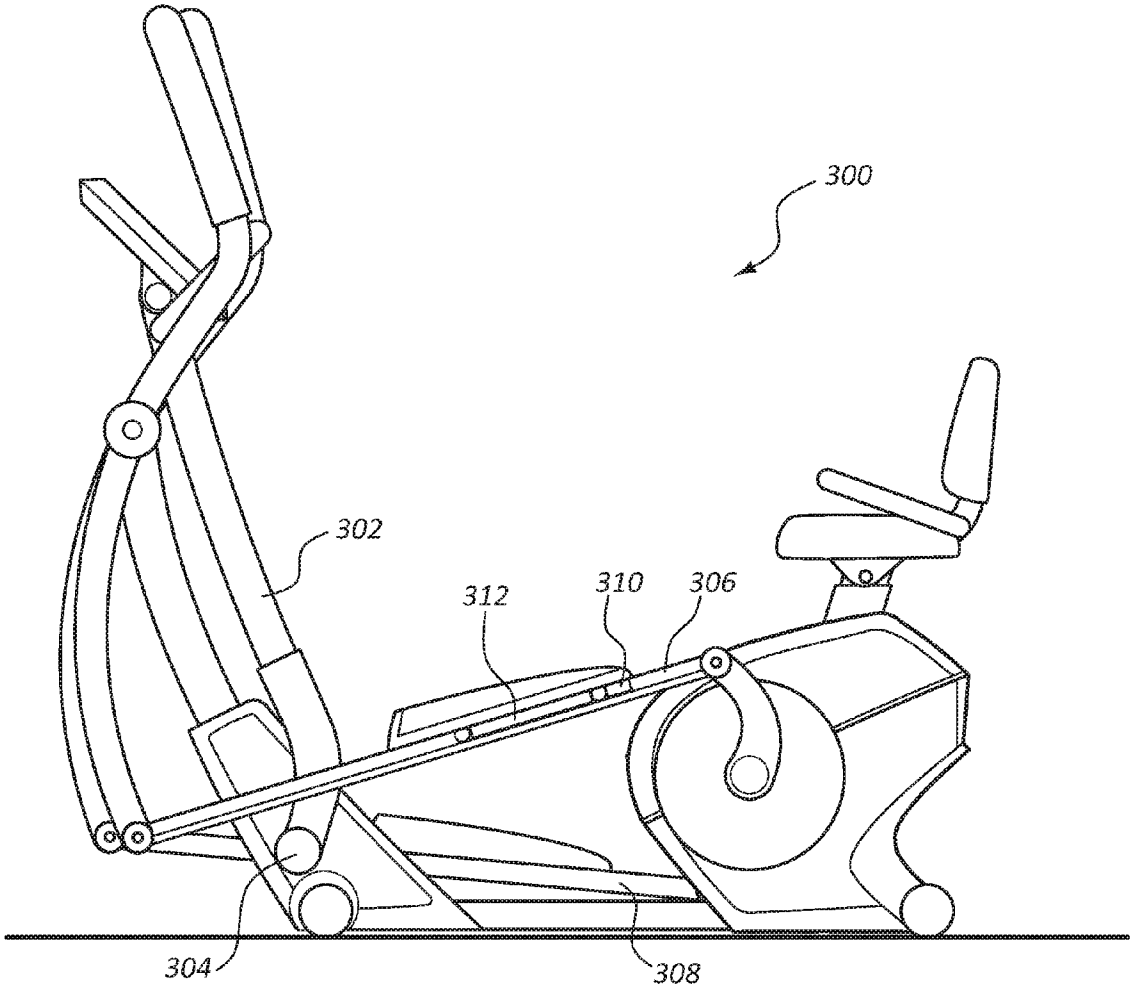
FIG. 3 illustrates a side view of an example of an exercise machine in an elliptical mode accordance with the present disclosure.

FIG. 3 depicts an example of an exercise machine 300 with the console member 302 moved forward about the console pivot member 304. The exercise machine 300 also includes a first beam 306 and a second beam 308. A first pedal 310 is attached to the first beam 306 through a first rod 312, and a second pedal is attached to the second beam 308 through a second rod. In this example, the first and second rods are moved forward to where the first and second pedals are flush with the first and second beams 306, 308 respectively.

Figure 4:
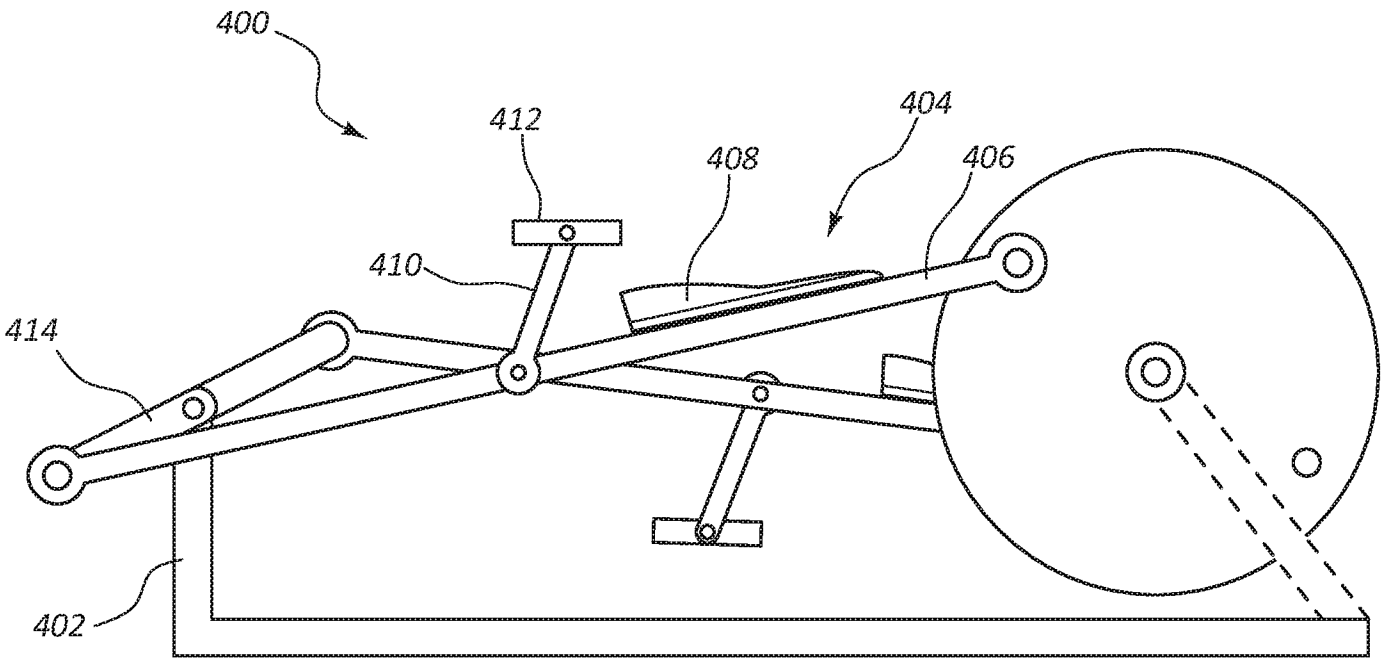
FIG. 4 illustrates a side view of an example of an exercise machine in accordance with the present disclosure.

FIG. 4 depicts an example of an exercise machine 400. In this example, the exercise machine 400 includes a frame 402 and a pedal assembly 404 movably attached to the frame 402. The pedal assembly 404 is movable in the performance of an exercise. The pedal assembly 404 comprises a first beam 406, a first platform 408 connected to the first beam 406, a first rod 410 connected to the first beam 406, and a first pedal 412 connected to the first rod 410.

While the examples above have been described with various members, angles, connection points, and components, any appropriate type and orientation of the members, angles, connection points, components, and so forth may be used in accordance with the principles described herein. Thus, the embodiments above manifest just some of the examples of the invention and do exclusively depict all possible embodiments of the invention.

Figure 5:
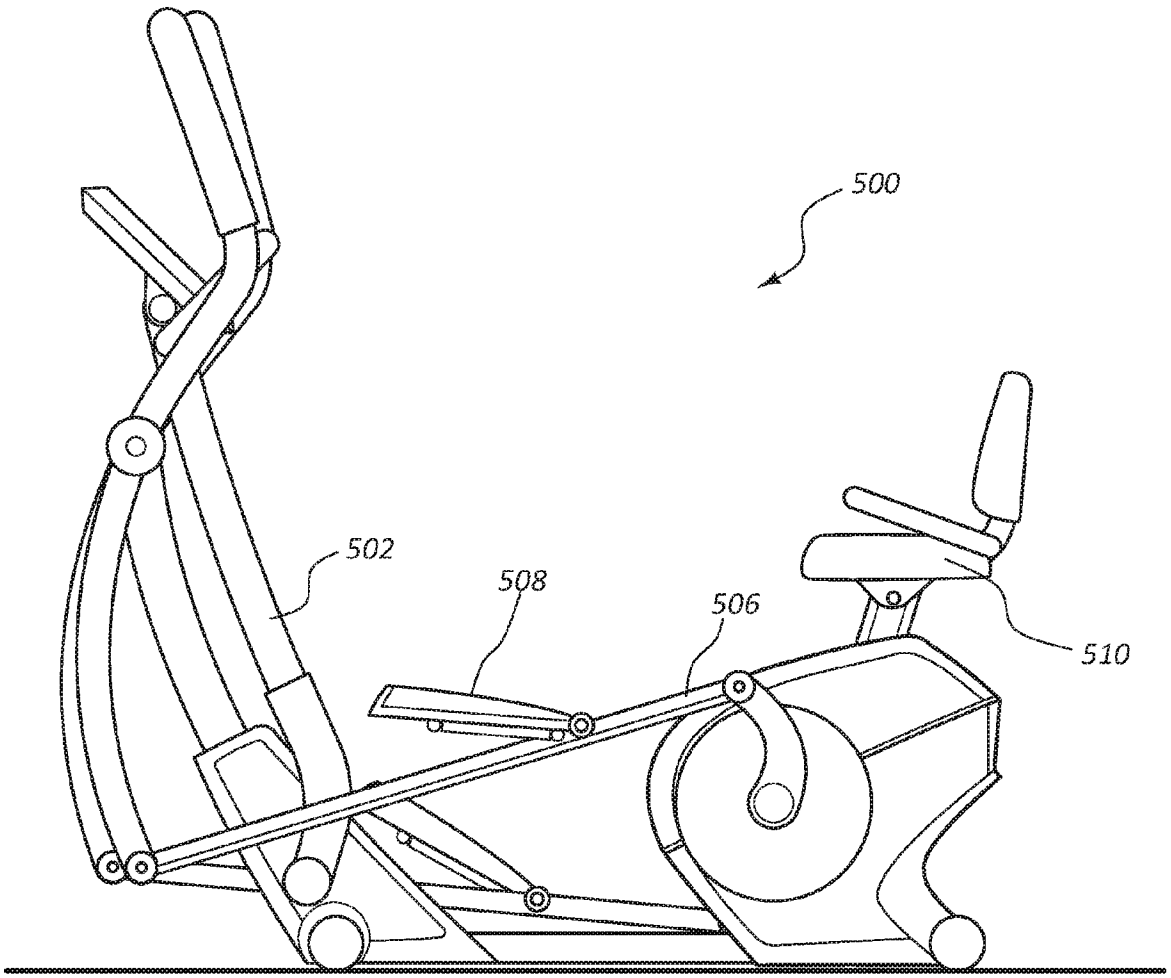
FIG. 5 illustrates a side view of an example of an exercise machine in accordance with the present disclosure.

FIG. 5 depicts an example of an exercise machine 500. In this example, the exercise machine 500 includes a frame 502 and a pedal assembly movably attached to the frame 502. The pedal assembly comprises a beam 506 and a pedal 508 connected to the first beam 506. In this example, the pedal 508 is hingedly attached to the beam 506 on a side of the pedal 508 that is closest to a seat 510 of the exercise machine 500. Thus, the position of the pedal 508 is adjustable along an arc. During the upright cycling mode, the pedals 508 may be angled to be relatively aligned with the beam 506. During the recumbent cycling mode, the pedals 508 may form a steeper angle with the beam 506 by being rotated upwards about the hinged connection. In each position, a locking mechanism may ensure that the angle of the pedal 508 is maintained during the performance of the exercise based on the exercise machine's current exercise mode. Further, in some examples, a gas spring, a lever, or another type of mechanism may be used to provide additional support to the pedal 508 when the pedal is rotated upwards. Further, the angle of the pedals 508 may be controlled by an actuator. In some of such examples, the user may be able to control the pedal angle from commands delivered through the console.

Figure 6:
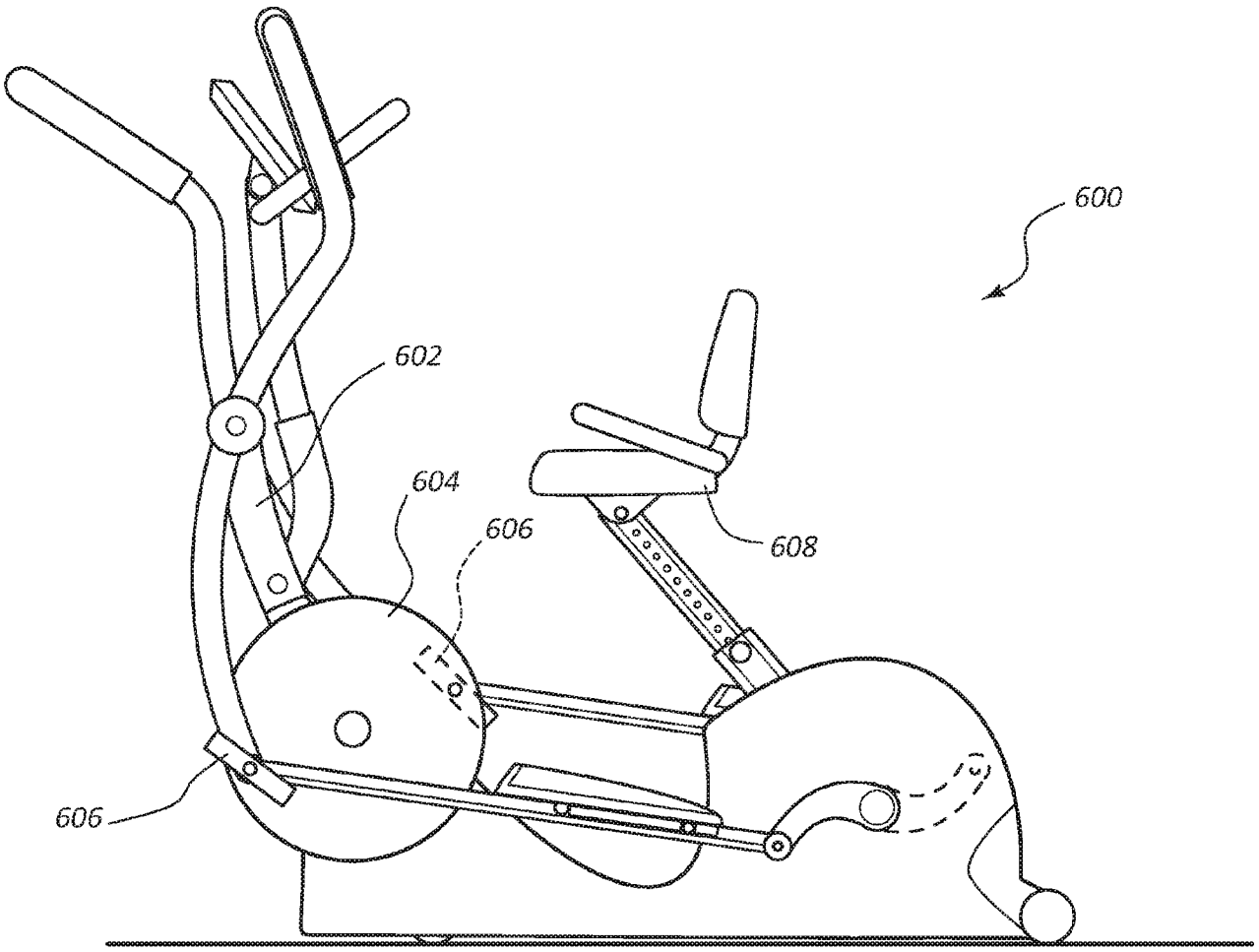
FIG. 6 illustrates a side view of an example of an exercise machine in accordance with the present disclosure.

FIG. 6 depicts an example of an exercise machine 600. In this example, the exercise machine 600 includes a frame 602 and a flywheel 604. In this example, the flywheel 604 is located in a front of the exercise machine 600. A pedal 606 is movably attached to the flywheel 604. In such an example, the seat 608 moves relative to the flywheel 604 when transitioning between the upright cycling mode and the recumbent cycling mode to give the user the appropriate orientation during the performance of the desired exercise. In this example, the seat 608 is supported by a telescoping support member that is angled forward. As the telescoping frame member moves upwards, the seat 608 moves upwards and forward to position the seat 608 in an upright cycling mode orientation. Similarly, as the telescoping support member is moved downward, the seat also moves downward and rearward to position the seat in a recumbent cycling mode orientation. In some examples, the seat 608 can be manually positioned by the user. In other examples, the position of the seat 608 is controlled by an actuator. In at least some of the examples where the seat's position is controlled by an actuator, the user may input commands through the console to cause the seat 608 to move.

In some examples, the distance between the pedals 606 and the seat 608 is the same regardless of where the seat 608 is positioned along the path defined by the telescoping support member. However, in other examples, the distance between the pedals 606 and the seat may be different depending on the exercise machine's current mode. In the example of FIG. 6, the pedals 606 are connected to the flywheel 604 on the same axle that connects the beam and the arm support to the flywheel 604. However, in other examples, the pedals 606 may be connected to the flywheel 604 at a different location than where the beam and arm support are connected.

INDUSTRIAL APPLICABILITY

In general, the invention disclosed herein may provide the user with an exercise machine that has multiple exercise modes. A first exercise mode may be an upright cycling mode, a second exercise mode may be a recumbent cycling mode, and a third exercise mode may be an elliptical trainer exercise mode. In other examples, the exercise machine may include additional exercise modes that are intended to cause the user to perform different types of workouts. The different exercise modes may work out different types of muscles groups.

In the upright cycling mode, the seat is positioned relative to the pedals such that the user is caused to sit upright during the performance of a cycling exercise. The relative position of the seat with the pedals may allow the user to lean forward in a comfortable convenient manner. Thus, in examples where the seat includes a back rest, the user is positioned such that the user's back does not likely rest on the back rest. In such examples, the user's weight is supported by just the exercise machine on the padded region of the seat region, the pedals, and the handles. In the upright orientation, the user may primarily assume a vertical orientation.

In the recumbent cycling mode, the seat is positioned relative to the pedals such that the user is caused to have a reclined position during the performance of a cycling exercise. The user may conveniently load a portion of his or her body weight against a back support of the exercise machine's seat while in the recumbent position. Thus, in such examples, the user is positioned so that his or her weight is supported by the padded region of the seat region, the pedals, the handles, and the back rest of the seat. In the recumbent orientation, the user may primarily assume a horizontal orientation.

In the elliptical trainer exercise mode, the pedals and console are positioned such that the user can stand on the beams without interference. The user can stand on the pedals and conveniently reach the arm supports. As the user moves the beams with his or her feet, the beams move in a reciprocating motion. In examples where the arm supports are linked to the beams, the reciprocating motion of the beams cause the arm supports to likewise move in a reciprocating motion with the beams.

In one example of the invention, the exercise machine includes a resistance mechanism that is connected to a frame. The resistance mechanism may include a flywheel that is proximate a magnetic unit which resists the movement of the flywheel. In examples where the magnetic unit exhibits a consistent magnetic field, the amount of resistance applied to the flywheel may be changed by moving the magnetic unit towards or away from the flywheel. For example, the resistance applied to the flywheel may be increased by moving the magnetic unit closer to the flywheel. In other examples, the resistance applied to the flywheel may be decreased by moving the magnetic unit closer to the flywheel. In some cases, the magnetic unit may emit a variable amount of magnetic resistance by applying a varying amount of electrical power to the magnetic unit. While this example has been described with reference to a resistance mechanism that includes a flywheel and a magnetic unit, any appropriate type of resistance unit may be used in accordance with the principles described herein. A non-exhaustive list of resistance mechanisms that may be used include an air resistance mechanism, a fan, a hydraulic mechanism, a pneumatic mechanism, another type of resistance mechanism, or combinations thereof.

A crank assembly may be attached to the resistance mechanism. For example, the crank assembly may include a crank axle connected to a first crank arm and a second crank arm. The first crank arm may be attached to a first beam on a first end and to a first arm support on a second end. The first arm support may be pivotally attached to the frame at a pivot connection. The second crank arm may be attached to a second beam on a first end and to a second arm support on a second end. The second arm support may also be pivotally attached to the frame at the pivot connection. In examples where the beams are linked to the arm supports, the arm support may move in a reciprocating motion with the beams. In other examples, the beams are mechanically separated from the arm supports. In such examples, the arm supports move independently of the beams. Thus, the reciprocating movement of the arm supports is caused by the movement of the user's arms rather than the combined movement of the user's feet and arms.

A platform may be attached or formed on the beams. The platform may an element or an assembly that provides a location for a user to place his or her foot and transfer power to the beam during the performance of an exercise. The platforms may be located on the pedal beams in positions where the user can conveniently stand while performing an elliptical training exercise when the exercise machine is in the elliptical training exercise mode. A first platform is attached to the first beam. In this example, the first platform is directly attached to a surface of the first beam, and the first platform is supported by the first beam along the first platform's length. Likewise, a second platform is attached to the second beam. In this example, the second platform is directly attached to a surface of the second beam, and the first platform is likewise supported by the second beam along the first platform's length. The first and second platforms may be attached to the beams through any appropriate mechanism. For example, the platforms may be connected to the beams with fasteners, bolts, wires, adhesives, welding, soldering, other types of mechanisms, or combinations thereof. In yet other examples, the platforms may be integrally formed with the beams. In one such example, the beams may comprise an increased width in the beam's region where the user is intended to place his or her feet during the elliptical trainer exercise mode. Such a platform may include a gripping feature to provide additional friction to increase the user's stability during the performance of the elliptical training exercise.

While in the elliptical exercise mode, the user may place his or her feet on the platforms and move his or her feet in a reciprocating motion. In response to such an action by the user, the beams may move. In some examples, one end of the beam is attached to the crank arm of the resistance mechanism and the other end of the beam is attached to an arm support. However, in other examples, the other end of the beams may be attached to the frame. In yet other examples, the other end of the beams are attached to linkages that movably connect the other ends of the beams to the frame.

The pedals may be used in either the upright or recumbent cycling modes. In the upright cycling mode, pedals are positioned more rearward. Further, the seat may be positioned at an elevated height. In such an arrangement, an imaginary line that travels the distance between the pedals and the seat may comprise a primary vertical component. In the recumbent position, the seat may lowered and the pedals moved forward. In some examples when the seat is lowered and the pedals are brought forward, the distance between the pedals and the seat is approximately the same distance as when the exercise machine is in the upright position. However, in the recumbent position, the imaginary line that travels the distance between the seat and pedals comprises a primary horizontal component. With the relatively horizontal positional relationship between the seat and the pedals, the user is in a reclined positioned during the performance of the cycling exercise. While the examples above have been described with the distance between the seat and the pedals being approximately the same in both the upright cycling mode and the recumbent cycling mode, in alternative examples, the distance between the seat and pedals in the upright cycling mode and the recumbent cycling mode may be different.

A first pedal is attached to the first beam with a first rod. The first rod may be positioned in an upright orientation that forms a rearward angle between the first rod and the first beam. The rearward angle may be maintained during the performance of an exercise such that there is no relative movement between the rod and the beam during the cycling exercise. However, the pedal may be free to rotate about a pedal axle that joins the pedal to the rod. Likewise, a second pedal may be attached to the second beam with a second rod.

In the upright and recumbent cycling positions, the pedals are separated a distance away from the beams. In some examples, as the user moves the pedals during the performance of a cycling exercise, the pedals travel in a generally circular path. The rods may be positioned at an appropriate angle with respect to the user's seat and to the beams that the pedal travel along a circular path even though the beams themselves travel along a path that has a major axis and a minor axis. Thus, the circular path traveled by the pedals is determined by the angle and length of the crank arm, the angle and length of the beam, and the angle and length of the rod. In some examples, the rod has a preset position when in the upright cycling mode so that the pedals can travel in the circular path during the performance of an upright cycling exercise. Likewise, in some examples, the rod has a preset position when in the recumbent cycling mode so that the pedals can travel in the circular path during the performance of a recumbent cycling exercise. However, in other examples, the pedals assemblies are arranged such that the pedals can travel in an elliptical path with a minor and major axis during the performance of an upright cycling exercise and/or a recumbent cycling exercise.

The rod may be selectively positioned to be in any of the exercise modes. In some examples, the rod can be selectively positioned manually. In such an example, the rod may be manually rotated about a pivot connection and locked in place. Any appropriate locking mechanism may be used. For example, the rod may be spring loaded against the beam and caused be interlocked in place with a feature formed in the beam. To move the rod from one position to another, the user may pull the rod away from the beam with a force sufficient to overcome the spring force. With the rod pulled away from the beam, the rod unhooks from the interlocking feature of the beam and frees the rod to be rotated into the desired position. With the rod aligned with the desired position, the rod may be gradually released from the user allowing the rod to return to the beam and interlock with an interlocking feature of the beam in the desired position.

In another example, the rod may be fastened into place with a fastener. In such an example, the rod may pivot about a pivot axle. A hole in the rod may be aligned with one of multiple holes in the beam, where at least some of the holes formed in the beam correspond with the positions for different exercise modes. When the hole in the rod is aligned with the desired hole, a screw or another type of fastener may be inserted into both holes to lock the rod to the beam.

In another embodiment, the rod may be positioned with an actuator. For example, the rod may be positioned with a screw motor that moves the angle of the rod about the pivot axle as the screw motor rotates. A non-exhaustive list of actuators may include hydraulic actuators, pneumatic actuators, motors, solenoids, smart materials, electric actuators, gas springs, pulleys, other types of actuators, or combinations thereof.

While the examples above have been described with reference to rods that pivot, the rod may be moved in other appropriate ways. For example, the rods may have a slidable connection with the beam. In yet other examples, the rod may be removably attached to the beam such that the user can detach the rod from the beam at a first position corresponding with a first exercise mode and reattach the rod at a second position corresponding with a second exercise mode. In even additional examples, the rod may be moved through a telescope mechanism. Further, the rod may have an articulated joint that joins a first part of the rod to a second part of the rod. The first part of the rod may be connected to the beam, and the second part of the rod may be connected to the pedal. The second part of the rod may move with respect to the first part of the rod. In such an example, the first part of the rod may remain stationary with respect to the beam while the second part of the rod moves to position the pedal.

The pedals may be moved out of the way of the user when the exercise machine is in the elliptical trainer exercise mode. In such an example, the user may use the platforms of the beams to transfer foot power into the exercise machine instead of through the pedals as in the cycling exercise modes. In an example where the rod is pivotally attached to the beam, the pedals may be lowered to an angle of 15.0 degrees or less with respect to the beam. In such an example, the rod may move sufficiently out of the way of the user's feet during the performance of an elliptical trainer exercise. Further, the pedal may be out of the user's way as the user mounts and/or dismounts the exercise machine. In some examples, the rod is moved to be flush with the beam. The rod may form an angle of 10.0 degrees or less with the beam or an angle of 5.0 degrees or less with the beam when the exercise machine is in the elliptical exercise mode. In yet other examples, the pedals are rotated horizontally out of the way from interfering with the user's feet during the performance of an elliptical exercise.

In some examples, the pedals are platform pedals that are connected directly to the pedal assembly's beam. In such an example, the platform pedals may be hingedly attached to the beam on a side that is closest to the seat. As the seat changes elevations and/or angles, the platform pedals may pivot along an arc segment to appropriately angle the platform pedals for the desired exercise. For example, the platform pedals may be substantially aligned with the beam when the exercise machine is in the upright cycling mode and/or the elliptical mode. In other examples, the platform pedals may be oriented more transversely when the user is in the exercise machine is in the recumbent orientation. While this example has been described with the platform pedals being in the same orientation during both the upright cycling mode and the elliptical mode, the platform pedals may be oriented differently for each of the upright cycling and elliptical modes. For example, the pedals may be form a steeper angle with the beam during the upright cycling mode than in the elliptical mode.

In yet other examples, the pedals may be attached directly to the flywheel or another rotary element of the resistance mechanism. In such an example, the seat may move laterally and/or vertically to appropriately position the seat for the appropriate exercise mode. For example, the seat may be positioned at a higher elevation in the upright mode and at a lower elevation in the recumbent mode.

The seat may be movable with respect to the exercise machine's frame. In some examples, the seat's support rod may telescope with respect to a portion of the frame. In other examples, the support rod may be slidably attached to a portion of the frame. In some examples, the seat is brought to an upright position when the exercise machine is in the upright cycling mode, and the seat may be in a lower recumbent position when the exercise machine is in the recumbent position. In some cases, the seat may be in either the upright position or the recumbent position when the exercise machine is in the elliptical training exercise mode.

While the examples above have been described with a discrete upright position, a discrete recumbent position, and a discrete elliptical trainer position, for the seat and pedals, in some examples, the seat and pedals may be positioned anywhere along a continuum. For example, in some examples, the seat is positioned at a maximum height for the upright position, and the seat is positioned at a minimum elevation for a recumbent position. However, the seat may be adjusted to accommodate the different heights of the users. Further, the user may desire to position the seat at a height that is between the maximum and minimum positions (i.e. half way between the maximum and minimum positions). The pedals may be moved to be half way between the upright pedal orientation and the recumbent orientation to place the pedals at an appropriate distance away from the seat. According to one embodiment, the maximum position may place the seat over 36 inches vertically from the base, and the minimum position places the seat less than 36 inches vertically from the base.

The exercise machine may include a console member that connects the console to the exercise machine's frame. In some examples, the console member is selectively adjustable between multiple positions corresponding to different exercise modes of the exercise machine. The console member may be connected to a base portion of the frame and extend between 3.0 feet to 7.0 feet to a height that is convenient for the user to view while performing an exercise with the exercise machine. In other examples, the console member may be shorter and connected to a portion of the frame that is elevated higher than the base portion of the frame. The console member may be pivotally attached to the frame. In some examples, the console member may be positioned in the same location for both the upright and recumbent cycling modes. Such a console member position for the upright and recumbent cycling positions may occupy a three dimensional space that would be occupied by the user while the user is elliptical exercise mode. In such a circumstance, the console member may be moved to a forward position when the exercise machine is in the elliptical trainer exercise mode. In some embodiments, the console member has a different location in the upright cycling mode and the recumbent cycling mode.

The console may be moved manually in similar or different ways as described above with respect to the rods. For example, the console may be pivotally connected to the frame. In other examples, the console member may be slidably attached to the frame. In yet other examples, the console member may telescopically move with respect to the frame. Further, the console member may be movable manually or with an actuator.

The console may be movable with respect to the console member. In some examples, the console member may be tilted with respect to the console member. The tilt angle of the console may correspond to an exercise mode of the exercise machine. For example, the console may be tilted upward when the exercise machine is in the upright cycling mode. Further, the console may be tilted downward or straight forward in the recumbent exercise mode. In the elliptical mode, the console may be tilted upward or downward such that the tilt angle in the elliptical trainer exercise mode corresponds to either the upright cycling mode's console angle or the recumbent cycling mode's console angle. In some examples, the elliptical trainer exercise mode comprises a console tilt angle that is unique to the elliptical trainer exercise mode.

The console assembly may further include a pair of handles that the user may grip during the performance of an exercise. For example, the user may grip the handles attached to the console assembly when the user is in the upright position. A pair of handles incorporated into the seat may be within a convenient arms reach for the user while performing an exercise in the recumbent exercise mode. When performing the exercise in the elliptical trainer exercise mode, the user may grip the reciprocating arm supports. However, while the examples above have described the handles/arm supports that the user can use during the performance of different exercises in the different exercise modes, the user may grip any of the handles/arm supports within a convenient reach of the user and/or desirable by the user.

The console may include a display screen that indicates at least one operating parameter of the exercise machine or a physiological parameter of the user during the workout. For example, the display screen may depict the settings of the resistance mechanism, the speed at which the user is operating the exercise machine, the current exercise mode of the exercise machine, the estimated calories of the user's workout, the user's heart rate, the time of day, the time duration of the workout, other operating parameters, other physiological parameters of the user, or combinations thereof. In some examples, the calories burned estimate may be based on information gathered from the exercise machine's operating parameters. In some cases, at least some of the information used to determine the calorie burn is based on a user profile that contains personal information about the user, such as height, weight, age, gender, health conditions, body composition, other types of personal information, or combinations thereof. The personal information may be inputted into the console of the exercise machine. However, in other examples, the console may be in communication with a remote device that contains the user profile. For example, the console may be in wireless communication with a personal computer, a mobile device, a datacenter, a website, a network device, another type of device, or combinations thereof that contain at least one item of personal information about the user.

In some examples, the console may be in communication with a remote device that operates a fitness tracking program. In such an example, some of the personal information may be received from the fitness tracking program. Also, in some cases, the console may send information about the user's workout to the fitness tracking program. Such workout information may include the type and duration of the exercise, the resistance settings, the estimated number of calories burned, other types of information, or combinations thereof.

The console may also include at least one input mechanism for inputting information into the console. For example, the user may control the operating parameters of the exercise machine with the console. In some cases, the user can control the resistance settings through the console. Also, the user may be able to raise and lower the seat through commands inputted into the console. Further, the user may be able to control the position of the pedals though the console. Additionally, in some examples, the user can control the position of the console member through the console and/or control the console tilt angle through the console. The input mechanism of the console may include a button, lever, dial, touch screen, key board, microphone, another type of input mechanism, camera, or combinations thereof. In some examples, the user may command the exercise machine to change from one exercise mode to another. In such an example, the exercise machine may change the seat position, the pedal position, the console tilt angle, the console member position, any other positions to put the exercise machine in the desired exercise mode without further input from the user.

What is claimed is:

1. An exercise machine comprising:

a frame;

a console connected to the frame with a console member at a console member first position and including console handles, wherein the console is pivotally connected to the console member;

a resistance element connected to the frame;

two pedal assemblies, wherein each of the two pedal assemblies includes:

a beam attached to the resistance element at a beam first end;

a pedal rod pivotally connected to the beam at a pedal rod first end;

a pedal connected to the pedal rod at a pedal rod second end;

an arm support pivotally attached to the beam at a beam second end and pivotally attached to the frame;

a seat connected to the frame opposite the arm support, wherein the seat is moveable with respect to the frame;

wherein the exercise machine is changeable between a first configuration and a second configuration, and wherein the first configuration includes:

a first pedal assembly position, wherein the first pedal assembly position includes a pedal rod first angle between the pedal rod and the beam, wherein the pedal rod first angle is positioned rearward towards the seat and away from the console member, wherein there is no relative movement between the pedal rod and the beam in the first configuration;

a first seat position, wherein the first seat position is at an elevated height such that, in combination with the first pedal assembly position and the console member first position, the console handles, the seat, and the pedals are collectively configured to support a weight of a user;

wherein the second configuration includes:

a second pedal assembly position, wherein the second pedal assembly position includes a pedal rod second angle between the pedal rod and the beam, wherein the pedal rod second angle is positioned forward towards the console member and away from the seat, and wherein there is no relative movement between the pedal rod and the beam in the second configuration; and a second seat position, wherein the second seat position is at a lowered height relative to the elevated height such that, in combination with the second pedal assembly and the console member first position, the seat, a seat back attached to the seat, and the pedals are collectively configured to support the weight of said user.

2. The exercise machine of claim 1, wherein in the first seat position, an imaginary line that travels a distance between the seat and one of the pedals includes a primary vertical component.

3. The exercise machine of claim 1, wherein in the second seat position, an imaginary line that travels a distance between the seat and one of the pedals includes a primary horizontal component.

4. The exercise machine of claim 1, wherein a distance between the seat and one of the pedals is approximately the same in the first configuration and the second configuration.

5. The exercise machine of claim 1, wherein the exercise machine is further changeable between a third configuration, wherein the third configuration includes:

a third pedal assembly position, wherein the third pedal assembly position includes a pedal rod third angle, wherein the pedal rod third angle is positioned forward towards the console member and away from the seat, and aligned with the beam at an angle of 15 degrees or less; and a console member second position that is forward from the console member first position and configured such that there is no interference between a body of said user and the console when the weight of said user is supported by the two pedal assemblies in the third pedal assembly position.

6. An exercise machine comprising: two pedal assemblies, wherein both pedal assemblies include: a beam connected to a rotary resistance mechanism at a beam first end and a frame at a beam second end; a platform attached to a mid-region of the beam; a pedal rod pivotally connected to the beam; a pedal pivotally connected to the pedal rod; a seat attached to the frame with a telescoping connection; a console attached to the frame with a console member; and wherein the exercise machine includes a first mode, a second mode, and a third mode, the first mode including: a pedal assembly first configuration wherein: the pedal rod is connected to the beam with a pedal rod first angle, the pedal rod first angle being positioned rearward towards the seat and away from the console member; the seat is in a seat first position, wherein in the seat first position the seat is located at a higher elevation; and the console is in a console first position and the console member is in a console member first position, wherein in the console first position the console is tilted upwards and in a non-vertical plane; wherein the second mode includes: a pedal assembly second configuration wherein the pedal rod is connected to the beam with a pedal rod second angle, the pedal rod second angle being positioned forward towards the console member and away from the seat; the seat in a seat second position, wherein in the seat second position the seat is located at a lower elevation relative to the higher elevation; and the console is in a console second position and the console member is in a console member second position, wherein the console second position is different from the console first position; and wherein the third mode includes: a pedal assembly third configuration wherein the pedal rod is connected to the beam with a pedal rod third angle, the pedal rod third angle being positioned forward towards the console member and away from the seat, and aligned with the beam at an angle of less than 15 degrees; and the console is in a console third position and the console member is in a console member third position, wherein the console member third position is forward of the console member first position and the console member second position.

7. The exercise mechanism of claim 6, wherein the console member first position and console member second position are the same.

8. The exercise mechanism of claim 6, wherein the console second position is straight forward and having a primarily vertical component.

9. The exercise mechanism of claim 6, wherein the higher elevation is greater than 36 inches vertically from a base of the exercise machine and the lower elevation is less than 36 inches vertically from the base of the exercise machine.

10. The exercise mechanism of claim 6, wherein the configuration of the beam and the pedal rod is such that the pedal travels along a circular path.

11. The exercise mechanism of claim 6, wherein the pedal rod is continuously adjustable between the pedal rod first angle, the pedal rod second angle, and the pedal rod third angle.

12. The exercise mechanism of claim 6, wherein the two pedal assemblies include a first pedal assembly and a second pedal assembly, and wherein the first pedal assembly is located on a right side of the frame and the second pedal assembly is located on a left side of the frame.

13. An exercise mechanism comprising:

two pedal assemblies, wherein both pedal assemblies include:

a beam connected to a rotary resistance mechanism at a beam first end and a frame at a beam second end;

a platform attached to a mid-region of the beam;

a pedal rod pivotally connected to the beam;

a pedal pivotally connected to the pedal rod;

a seat attached to the frame with a telescoping connection;

a console attached to the frame with a console member;

a console member attached to and positionable relative to the frame;

wherein the exercise mechanism is changeable between a first mode, a second mode, and a third mode, wherein in the first mode a relative position of the seat and the pedals is configured to cause a user to assume an upright orientation, the first mode including:

a seat first position;

a pedal assembly first configuration; and a console member first configuration;

wherein in the second mode the relative position of the seat and the pedals is configured to cause said user to assume a recumbent orientation, the second mode including:

a seat second position;

a pedal assembly second configuration; and a console member second configuration;

wherein in the third mode the two pedal assemblies and the console member are positioned and configured such that said user can stand on the beams without interference, the third mode including:

a seat third position;

a pedal assembly third configuration;

a console member third configuration; and wherein the pedal assembly first configuration, the pedal assembly second configuration, and the pedal assembly third configuration are different, wherein the seat first position and the seat second position are different, and the console member third configuration is different from the console member first configuration and the console member second configuration.

14. The exercise mechanism of claim 13, wherein the pedal assembly first configuration includes the pedal rod connected to the beam with a pedal rod first angle and the pedal assembly second configuration includes the pedal rod connected to the beam with a pedal rod second angle, the pedal rod first angle being different from the pedal rod second angle.

15. The exercise mechanism of claim 14, wherein the pedal rod first angle is positioned rearward towards the seat and away from the console member, the seat first position is higher than 36 inches from a base of the exercise mechanism, the pedal rod second angle is positioned forward towards the console member and away from the seat, and the seat second position is lower than 36 inches from the base of the exercise mechanism.

16. The exercise mechanism of claim 13, wherein the console includes a pair of handles attached to the console.

17. The exercise mechanism of claim 13, wherein said user may change between the first mode, the second mode, and the third mode with an input to the console.

18. The exercise mechanism of claim 13, wherein the platform is the same as the pedal, and the platform is hingedly attached to the beam.

19. The exercise mechanism of claim 13, wherein the console member is pivotally attached to the frame.

20. The exercise mechanism of claim 13, wherein the console member first configuration includes a console first tilt, and the console member second configuration includes a console second tilt, the console first tilt being different than the console second tilt.

* * * * *